US006135899A

United States Patent [19]

Maruko

[11] Patent Number: 6,135,899

[45] Date of Patent: Oct. 24, 2000

[54] THREAD-WOUND GOLF BALL

[75] Inventor: Takashi Maruko, Chichibu, Japan

[73] Assignee: Bridgestone Sports Co., Ltd., Tokyo, Japan

[21] Appl. No.: 09/277,199

[22] Filed: Mar. 26, 1999

[30] Foreign Application Priority Data

Mar. 27, 1998 [JP] Japan ..... 10-100609

[51] Int. Cl.[7] ..... A63B 37/06

[52] U.S. Cl. ..... 473/376; 473/354; 473/357; 473/359; 473/365; 473/373; 473/374; 473/376; 473/377; 473/378

[58] Field of Search ..... 473/357, 359, 473/373, 374, 377, 378, 354, 365, 376

[56] References Cited

U.S. PATENT DOCUMENTS

| | | | |
|---|---|---|---|
| 4,679,794 | 7/1987 | Yamada | 273/235 R |
| 5,002,281 | 3/1991 | Nakahara | 273/220 |
| 5,300,325 | 4/1994 | Nealon | 427/379 |
| 5,314,187 | 5/1994 | Proudfit | 273/235 R |
| 5,542,663 | 8/1996 | Kato | 473/363 |
| 5,628,699 | 5/1997 | Maruko | 473/363 |
| 5,674,137 | 10/1997 | Maruko | 473/354 |
| 5,683,311 | 11/1997 | Kakiuchi | 473/354 |
| 5,688,191 | 11/1997 | Cavallaro | 473/373 |
| 5,702,311 | 12/1997 | Higuchi | 473/373 |
| 5,704,853 | 1/1998 | Maruko | 473/363 |
| 5,733,205 | 3/1998 | Higuchi | 473/376 |
| 5,779,561 | 7/1998 | Sullivan | 473/373 |
| 5,779,562 | 7/1998 | Melvin | 473/373 |
| 5,783,293 | 7/1998 | Lammi | 428/212 |
| 5,792,009 | 8/1998 | Maruko | 473/359 |
| 5,816,942 | 10/1998 | Hayashi et al. . | |
| 5,820,485 | 10/1998 | Hwang | 473/361 |
| 5,830,086 | 11/1998 | Hayashi | 473/376 |
| 5,873,796 | 2/1999 | Cavallaro | 473/365 |
| 5,885,172 | 3/1999 | Hebert | 473/354 |

FOREIGN PATENT DOCUMENTS

| | | |
|---|---|---|
| 9-253236 | 9/1997 | Japan . |
| 9-271534 | 10/1997 | Japan . |

*Primary Examiner*—Stephen F. Gerrity
*Assistant Examiner*—P. Kim
*Attorney, Agent, or Firm*—Sughrue, Mion, Zinn, Macpeak & Seas, PLLC

[57] ABSTRACT

In a thread-wound golf ball comprising a two-layer structure center ball consisting of an inner layer and an outer layer, a rubber thread layer, and a cover, the center ball has a diameter of 30–36 mm and a weight of 19.5–31.5 g. The center ball outer layer has a specific gravity of 1.0–1.2, a Shore D hardness at least 5 units lower than the inner layer, and a thickness of 1–6 mm. The cover has a thickness of 1–3 mm. This construction and combination of characteristics gives the golf ball excellent spin, control, flight performance, and distance at all club head speeds, and especially increased distance when hit by a low head-speed golfer.

13 Claims, 1 Drawing Sheet

THREAD-WOUND GOLF BALL

BACKGROUND OF THE INVENTION

1. Field of the Invention

The present invention relates to a thread-wound golf ball having excellent spin, control, flight performance, and "feel" upon impact, as well as increased distance even when hit by a relatively low club head-speed golfer.

2. Prior Art

Thread-wound golf balls have an excellent "feel" and control compared with two-piece and multi-piece solid golf balls comprising a solid core enclosed in one or more cover layers. However, when struck with a driver, for example, they have too much spin and not enough distance.

Numerous golf balls with improved control and flight performance have been proposed, including thread-wound golf balls that contain a center ball having a two-layer construction comprising an inner layer and an outer layer as disclosed, for example, in JP-A 253236/1997 and JP-A 271534/1997.

However, there is room for improvement in the distance and "feel," when hit by a low head-speed player, of all such golf balls containing a center ball with a two-layer construction. Specifically, the golf ball of JP-A 253236/1997 suffers from the problems of excessive spin, a low launch angle, and short distance because the outer layer of the center ball is too hard. The golf ball of JP-A 271534/1997 in which the center ball outer layer is composed primarily of a resinous material acquires an insufficient initial velocity due to differences in resilience between the inner and outer layers.

SUMMARY OF THE INVENTION

Therefore, it is an object of the present invention to provide a thread-wound golf ball having excellent spin, control, flight performance, and "feel" at all club head speeds, and in particular increased distance when hit by a low club head-speed golfer.

The invention is directed to a thread-wound golf ball comprising a center ball, a layer of rubber thread wound about the center ball, and a cover that encloses the rubber thread layer, wherein the center ball has a two-layer construction comprised of an inner layer and an outer layer. We have found that by optimizing the diameter and weight of the center ball, as well as the respective thicknesses of the outer layer and the cover, the thread-wound golf ball is tailored so as to provide excellent spin, control, and flight performance at all head speeds.

Specifically, thread-wound golf balls in which the center ball is adjusted to a diameter of 30 to 36 mm and a weight of 19.5 to 31.5 g, the outer layer is given a specific gravity of 1.0 to 1.2, a lower Shore D hardness than the inner layer and a thickness of 1 to 6 mm, and the thickness of the cover is set at 1 to 3 mm are able to fully demonstrate the above-described effects. In particular, these golf balls are capable of increasing the distance achieved even by relatively low head-speed golfers.

Accordingly, this invention provides a thread-wound golf ball comprising a center ball, a layer of rubber thread wound about the center ball, and a cover that encloses the rubber thread layer, which center ball has a two-layer construction comprised of an inner layer and an outer layer; wherein the center ball has a diameter of 30 to 36 mm and a weight of 19.5 to 31.5 g, the outer layer has a specific gravity of 1.0 to 1.2, a Shore D hardness at least 5 units lower than the inner layer, and a thickness of 1 to 6 mm, and the cover has a thickness of 1 to 3 mm.

BRIEF DESCRIPTION OF THE DRAWING

The sole FIGURE.

DETAILED DESCRIPTION OF THE INVENTION

Figure 1:
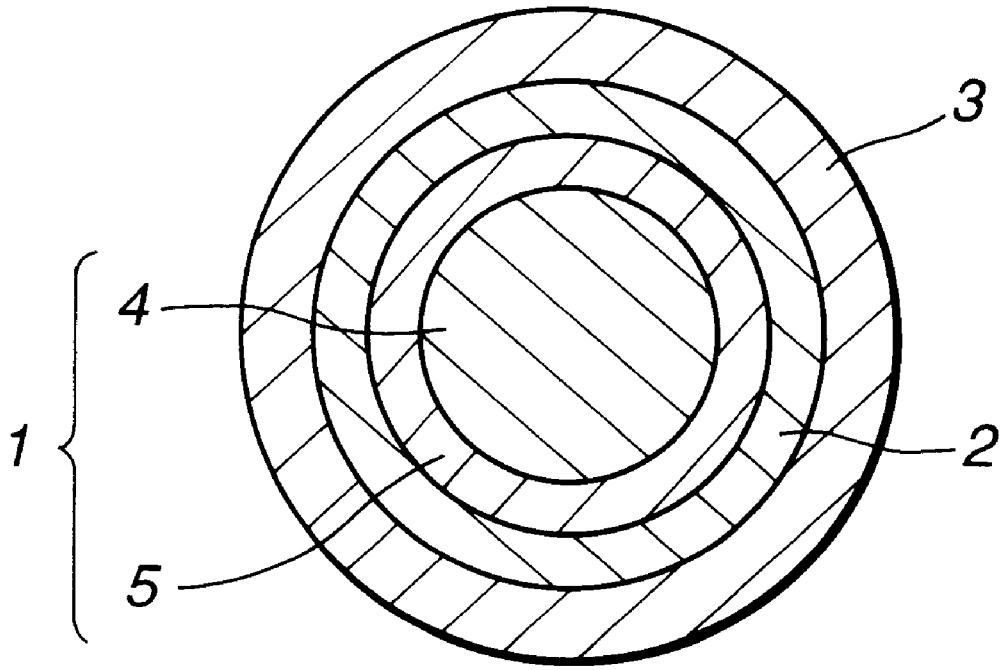
FIG. 1 is sectional view of a thread-wound golf ball according to one embodiment of the present invention.

Referring to FIG. 1, the thread-wound golf ball of the present invention is illustrated as comprising a center ball 1, a layer 2 of rubber thread wound about the center ball 1, and a cover 3 that encloses the rubber thread layer 2. The center ball 1 has a two-layer construction comprised of a spherical inner layer 4 on the surface of which is formed an enclosing outer layer 5.

The inner layer 4 of the center ball 1 may be formed, as the main component, of a rubber composition composed primarily of a base rubber or a resin composition composed primarily of a resin component.

When the inner layer 4 is formed of a rubber composition, 1,4-polybutadiene is preferably used as the main ingredient therein. The use of 1,4-polybutadiene having a cis structure of at least 40%, and especially at least 90%, is recommended. Where desired, natural rubber, polyisoprene rubber, styrene-butadiene rubber or the like may be suitably compounded with the 1,4-polybutadiene. However, to enhance the rebound characteristics of the golf ball, these other rubber ingredients should preferably be compounded in an amount not greater than 10 parts by weight per 100 parts by weight of the 1,4-polybutadiene.

In addition to these rubber components, a crosslinking agent may be blended into the rubber composition. Examples include the zinc salts and magnesium salts of unsaturated fatty acids, such as zinc methacrylate and zinc acrylate, and ester compounds such as trimethylpropane methacrylate. Of these, the use of zinc acrylate is especially preferred for achieving high rebound characteristics. These crosslinking agents are preferably compounded in an amount of from 25 to 45 parts by weight per 100 parts by weight of the base rubber.

A vulcanizing agent is also generally compounded in the rubber composition. It is recommended that the vulcanizing agent include a peroxide having a 1-minute half-life temperature of not more than 155° C., the amount of this peroxide being at least 30% by weight, and especially 40 to 70% by weight, of the overall amount of vulcanizing agent. Examples of suitable peroxides include commercially available products such as Percumyl D and Perhexa 3M (both produced by Nippon Oils and Fats Co., Ltd.). The amount of the vulcanizing agents formulated into the rubber composition may be set at 0.1 to 5 parts by weight per 100 parts by weight of the base rubber.

Other suitable ingredients may also be compounded into the rubber composition as needed, including antioxidants, and fillers such as zinc oxide and barium sulfate for adjusting the specific gravity. The fillers are preferably blended in an amount of from 5 to 130 parts by weight per 100 parts by weight of the base rubber.

In the other preferred embodiment wherein the inner layer is formed of a resin composition, resin components that may be used include resins having relatively high melting points, such as nylon and polyester. An example of a suitable resin component is nylon 11. In addition to the resin components, fillers and lubricants such as the metal salts of stearic acid may be suitably included in the resin composition.

In the practice of the invention, a filler can be advantageously used as a specific gravity modifier in the rubber composition or resin composition of which the inner layer is formed. Adjustment of the specific gravity is preferably carried out using a filler having a specific gravity of at least 6.0, preferably 6.5 to 10.5, and more preferably 7.0 to 9.0. The incorporation of a filler having a high specific gravity allows the proportion of the rubber or resin ingredients in the inner layer to be increased, which in turn enhances the rebound characteristics and impact durability of the golf ball.

Exemplary fillers of this type include metal powders, such as powders of metals having an atomic number of 21 to 28, these being used singly or as combinations of two or more thereof. From the standpoint of cost, chromium, iron, and nickel powders are preferred, with the use of iron and nickel powders being especially preferred. Examples of other metal powders suitable for this purpose include powders of titanium, tungsten, molybdenum, zirconium, vanadium, hafnium, gold, and silver.

To enable uniform dispersion within the rubber composition or resin composition of the inner layer, the filler is preferably in powder form. The filler in the form of a sponge or ground fragments may also be used so long as it can be worked into the inner layer composition. It is recommended that the mean particle size of the filler be from 0.1 to 300 microns, preferably from 1 to 100 microns, and especially from 50 to 100 microns. Finer filler particles with a mean particle size of less than 0.1 micron tend to scatter during the kneading operation, dirtying the work environment, whereas coarse filler particles with a mean particle size greater than 300 microns are inefficient to disperse in the composition, making it difficult to obtain the intended effects of compounding the filler.

To enable a higher proportion of rubber ingredients in the outer layer and thus enhance the rebound characteristics of the golf ball, it is advantageous that the specific gravity of the inner layer be set within a range of 1.2 to 2.0, and especially 1.3 to 1.7.

A suitable method known to the art may be employed to obtain the inner layer using the above-described rubber composition or resin composition. In the case of a rubber composition, the composition may be worked with a conventional kneading apparatus such as a Banbury mixer, kneader, or roll mill, and the resulting compound compression-molded using an inner-layer mold. In the case of a resin composition, the composition may be worked, then shaped by a process such as injection molding within an inner-layer mold.

As discussed subsequently, the Shore D hardness of the inner layer formed in the above manner is at least 5 units higher than that of the outer layer (that is, the inner layer is harder than the outer layer). The Shore D hardness of the inner layer is preferably from 35 to 60, and especially from 40 to 55.

The diameter of the inner layer is suitably adjusted according to the thickness of the outer layer and the diameter of the center ball, both of which are discussed later, but is preferably within a range of 22 to 35 mm, and especially 23 to 33 mm.

The center ball 1 comprises also an outer layer 5 enclosing the surface of the inner layer 4 just described.

The specific gravity of the outer layer 5 must be within a range of 1.0 to 1.2, and preferably 1.05 to 1.15. At a specific gravity of less than 1.0, the outer layer lacks a suitable hardness, making it impossible to achieve sufficient rebound characteristics (the ZAA is too low). At a specific gravity greater than 1.2, the proportion of rubber constituents in the outer layer decreases, which also leads to insufficient rebound.

As already noted, the Shore D hardness of the outer layer 5 must be at least 5 units, and preferably at least 10 units, lower than the Shore D hardness of the inner layer 4. The Shore D hardness of the outer layer 5 is preferably from 20 to 45, and especially from 25 to 40. Unless the hardness of the outer layer is made lower as just described than the hardness of the inner layer, the outer layer, which has been formulated for high resilience, becomes incapable of sufficient deformation, resulting in a decline in the rebound characteristics of the golf ball.

The thickness of the outer layer 5 is from 1 to 6 mm, and preferably from 2 to 5 mm. If this layer is thinner than 1 mm, the golf ball has a poor "feel" upon impact and a poor durability, in addition to which the layer cannot improve the rebound characteristics. On the other hand, a layer thicker than 6 mm results in deformation and other defects at the time of production.

The outer layer 5 that satisfies the above conditions may be composed primarily of either a rubber composition or a resin composition. Suitable use can be made of the same compositions as those mentioned above for the inner layer, although a 1,4-polybutadiene-based rubber composition is preferable in terms of adjusting the hardness profile of the center ball.

The filler compounded in the rubber composition for the outer layer is included in a ratio per 100 parts by volume of rubber of preferably up to 20 parts by volume, more preferably up to 18 parts by volume, and even more preferably from 5 to 16 parts by volume. At a filler ratio greater than 20 parts by volume, the rebound characteristics of the golf ball may decrease.

The outer layer 5 may be formed from this outer layer material by a method wherein a compound is prepared in the same manner as for production of the inner layer, following which this compound is subjected to semi-vulcanization in a hemispherical half-cup shape, and the resulting half-cups are bonded over the inner layer.

The center ball having a two-layer construction obtained in this manner is formed to a diameter of 30 to 36 mm, preferably 30 to 33 mm, and a weight of 19.5 to 31.5 g, preferably 19.5 to 26.0 g. At a center ball diameter greater than 36 mm, sufficient rubber thread cannot be wound onto the center ball since the golf ball obtained is to have a diameter within the same range as commercial golf balls, and so the ball has inferior rebound characteristics. On the other hand, the center ball with a diameter less than 30 mm is too small to provide a rebound enhancing effect.

The inventive golf ball is a thread-wound golf ball obtained by winding rubber thread about the center ball 1 as to form a rubber thread layer 2 over the center ball 1, then enclosing this rubber thread layer 2 within a cover 3. The density of the rubber thread layer 2 is preferably from 0.65 to 0.85 g/cm$^3$, and especially 0.7 to 0.8 g/cm$^3$. The density of the rubber thread layer 2 is defined here as the value obtained by dividing the total weight of the rubber thread layer by its volume (which is equal to the volume of the golf ball minus both the volume of the cover and the volume of the center ball).

Any suitable known type of rubber thread and winding method may be used without particular limitation in winding rubber thread about the center ball 1. For example, rubber thread having a specific gravity of 0.93 to 1.1, especially 0.93 to 1, a width of 1.4 to 2 mm, especially 1.5 to 1.7 mm, and a thickness of 0.3 to 0.7 mm, especially 0.4 to 0.6 mm, is preferred.

In the practice of the invention, the cover 3 may be obtained with a known golf ball cover resin. Resins that may be selected for such use include ionomer resins, polyurethane 25 resins, polyester resins, and balata rubber. Of these, the use of an ionomer resin is preferred. Exemplary resins include ionomer resins manufactured by DuPont-Mitsui Polychemicals Co., Ltd. under the trade name designation Himilan and by E. I. duPont under the trade name designation Surlyn, and thermoplastic polyurethane elastomers manufactured by Dainippon Ink & Chemicals, Inc. under the trade name designation Pandex.

The specific gravity and other properties of the cover stock may be modified by the addition of a filler such as titanium dioxide or barium sulfate. UV stabilizers, antioxidants, dispersants such as metallic soaps, and other additives may also be included if necessary. Examples of ionomer resins that may be used in the cover stock include ionomers manufactured by DuPont-Mitsui Polychemicals Co., Ltd., such as Himilan 1855, 1856, 1652, 1605, and 1706, and ionomers manufactured by E.I. du Pont de Nemours & Co., such as Surlyn 8120, 7930, 7311, and AM8542. The use of a mixture of an ionomer having monovalent neutralizing metal ions such as sodium or lithium with an ionomer having divalent neutralizing metal ions such as zinc or magnesium is especially preferred.

The method generally used to form the cover involves injection-molding the cover over the thread-wound core. Use may also be made of a method which comprises injection molding the cover stock into a pair of hemispherical half-cups, and enclosing the thread-wound core with the pair of half-cups, followed by compression molding.

The cover 3 has a thickness of 1 to 3 mm, and preferably 1.5 to 2.5 mm. At less than 1 mm, the cover has insufficient strength should the golf ball be topped when hit, resulting in poor ball durability. On the other hand, a cover thicker than 3 mm results in a poor "feel" and insufficient rebound characteristics.

The cover can be formed of one or more layers. If the cover has multiple layers, the total thickness of these layers should fall within the above range in the cover thickness.

No particular limit is imposed on the hardness of the cover 3 formed as described above, although a Shore D hardness of 30 to 70, and especially 35 to 65, is preferred.

The thread-wound golf ball of the invention may have dimples of a type and arrangement known to the art formed thereon by a known method. The ball itself may be formed so as to have a diameter and weight which are not less than 42.67 mm and not greater than 45.92 g, respectively, in accordance with the Rules of Golf.

EXAMPLES

The following examples and comparative examples are provided to illustrate the invention, and are not intended to limit the scope thereof.

Examples 1–5 & Comparative Examples 1–3

The rubber compositions shown in Table 1 and the resin compositions shown in Table 2 were each worked in a roll mill or a twin-screw extruder, following which the rubber compositions were heat and pressure molded at 155° C. for 15 minutes, and the resin compositions were injection molded in a mold, thereby forming a spherical inner layer. In each of these examples, the corresponding outer layer shown in Table 4 was formed on the surface of the resulting inner layer to give a center ball having a two-layer construction.

The rubber thread described in Table 3 having a width of 1.6 mm and a thickness of 0.55 mm was wound onto this center ball by an ordinary winding method, thereby giving a thread-wound core having a diameter of 39.6 mm.

Separately, in both the inventive examples and the comparative examples, 100 parts by weight of the same ionomer resin shown in Table 2, a 50/50 mixture of Himilan 1605 and Himilan 1706 produced by DuPont-Mitsui Polychemicals Co., Ltd., was worked in a twin-screw extruder together with the amounts of titanium oxide and magnesium stearate indicated in Table 2, giving a cover stock. This cover stock was injection-molded into half-cups.

The resulting half-cups were placed over the thread-wound core, and compression-molded to form the cover. This resulted in the production of thread-wound golf balls all having identical covers and identical dimples.

These golf balls were measured for spin, initial velocity, angle of elevation, carry, and total distance when struck with a club at different head speeds (HS) of 35, 40 and 45 m/s. The results are presented in Table 4.

TABLE 1

| | (1) | (2) | (3) | (4) | (5) | (6) | (7) | (8) | (9) | (10) | (11) |
|---|---|---|---|---|---|---|---|---|---|---|---|
| Polybutadiene*1 | 100.0 | 100.0 | 100.0 | 100.0 | 100.0 | 100.0 | 100.0 | 100.0 | 100.0 | 100.0 | 100.0 |
| Zinc oxide | 10.0 | 10.0 | 10.0 | 10.0 | 65.0 | 60.0 | 5.0 | 19.6 | 31.7 | 38.0 | 60.0 |
| Zinc acrylate | 25.0 | 25.0 | 25.0 | 20.0 | 5.0 | 5.0 | 30.0 | 6.0 | 8.0 | 40.0 | 25.0 |
| Antioxidant*2 | 0.2 | 0.2 | 0.2 | 0.2 | 0.2 | 0.2 | 0.2 | 0.2 | 0.2 | 0.2 | 0.2 |
| Barium sulfate | | | | | | | 45.3 | | | | |
| Iron powder | 65.4 | 57.3 | 94.1 | 66.2 | | | | | | | |
| Percumyl D*3 | 1.2 | 1.2 | 1.2 | 1.2 | 1.2 | 1.2 | 1.2 | 0.4 | 0.4 | 0.4 | 0.4 |
| Perhexa 3M*3 | | | | | | | | 0.8 | 0.8 | 0.8 | 0.8 |

*1BR11, produced by Japan Synthetic Rubber Co., Ltd.
*2Nocrack NS-6, produced by Ouchi Shinko Kagaku Kogyo K.K.
*3A peroxide produced by Nippon Oils & Fats, Co.

TABLE 2

| | Inner layer A | Outer layer B | Cover |
|---|---|---|---|
| Hytrel 4047*4 | 100.0 | 100.0 | |
| Himilan 1605*5 | | | 50.0 |
| Himilan 1706*5 | | | 50.0 |
| Titanium oxide | | | 5.0 |
| Iron powder | 42.3 | | |
| Magnesium stearate | 1.0 | | 1.0 |
| Shore D hardness | 41 | 40 | 64 |

*4A polyester resin produced by DuPont-Toray Co., Ltd.
*5An ionomer resin produced by DuPont-Mitsui Polychemicals Co., Ltd.

TABLE 3

| | |
|---|---|
| Polyisoprene*6 | 70.0 |
| Natural rubber | 30.0 |
| Zinc oxide | 1.5 |
| Stearic acid | 1.0 |
| Vulcanizing accelerator + sulfur | 2.6 |
| Specific gravity of formulation | 0.93 |

*6Califlex IR305, produced by Shell Chemicals Co.

TABLE 4

| | Examples | | | | | Comparative Examples | | |
|---|---|---|---|---|---|---|---|---|
| | 1 | 2 | 3 | 4 | 5 | 1 | 2 | 3 |
| Inner layer of center ball | | | | | | | | |
| Formulation | (1) | (2) | (3) | (4) | A | (5) | (6) | (7) |
| Diameter (mm) | 27.8 | 27.8 | 24.0 | 27.8 | 27.8 | 22.1 | 27.8 | 31.9 |
| Weight (g) | 17.3 | 16.7 | 12.1 | 17.3 | 17.3 | 7.6 | 15.1 | 22.4 |
| Specific gravity | 1.538 | 1.485 | 1.670 | 1.538 | 1.538 | 1.345 | 1.335 | 1.320 |
| Shore D hardness | 50 | 50 | 50 | 42 | 41 | 21 | 20 | 55 |
| Outer layer of center ball | | | | | | | | |
| Formulation | (8) | (8) | (9) | (8) | (8) | (10) | (11) | B |
| Diameter*7 (mm) | 31.9 | 33.8 | 31.9 | 31.9 | 31.9 | 32.6 | 32.6 | 35.9 |
| Weight (g)*7 | 23.6 | 26.6 | 23.6 | 23.6 | 23.6 | 24.2 | 24.2 | 30.3 |
| Specific gravity | 1.095 | 1.095 | 1.180 | 1.095 | 1.095 | 1.329 | 1.333 | 1.120 |
| Shore D hardness | 32 | 32 | 31 | 31 | 31 | 63 | 49 | 40 |
| Thread-wound core | | | | | | | | |
| Diameter (mm) | 39.6 | 39.6 | 39.6 | 39.6 | 39.6 | 39.6 | 39.6 | 39.6 |
| Weight (g) | 35.0 | 35.0 | 35.0 | 35.0 | 35.0 | 35.2 | 35.2 | 35.2 |
| Cover | | | | | | | | |
| Thickness (mm) | 2.0 | 2.0 | 2.0 | 2.0 | 2.0 | 2.0 | 2.0 | 2.0 |
| Specific gravity | 0.97 | 0.97 | 0.97 | 0.97 | 0.97 | 0.97 | 0.97 | 0.97 |
| Shore D hardness | 64 | 64 | 64 | 64 | 64 | 64 | 64 | 64 |
| Finished ball | | | | | | | | |
| Diameter (mm) | 42.7 | 42.7 | 42.7 | 42.7 | 42.7 | 42.7 | 42.7 | 42.7 |
| Weight (g) | 45.2 | 45.2 | 45.2 | 45.3 | 45.3 | 45.4 | 45.4 | 45.4 |
| Hardness (mm) | 3.2 | 3.4 | 3.5 | 3.2 | 3.1 | 3.0 | 3.1 | 3.3 |
| HS = 35 m/s | | | | | | | | |
| Spin (rpm) | 4150 | 4030 | 3940 | 4060 | 4310 | 4660 | 4370 | 3920 |
| Initial velocity (m/s) | 49.3 | 49.2 | 49.1 | 49.3 | 49.0 | 48.7 | 48.7 | 48.3 |
| Angle of elevation (°) | 12.3 | 12.0 | 12.1 | 12.1 | 12.4 | 11.6 | 12.3 | 11.4 |
| Carry (m) | 138.9 | 134.3 | 136.3 | 137.3 | 136.7 | 133.5 | 134.3 | 132.1 |
| Total distance (m) | 155.9 | 154.7 | 152.0 | 154.9 | 152.9 | 148.3 | 149.8 | 147.2 |
| HS = 40 m/s | | | | | | | | |
| Spin (rpm) | 3000 | 2930 | 2760 | 2850 | 3180 | 3420 | 3310 | 2730 |
| Initial velocity (m/s) | 58.0 | 57.9 | 57.8 | 58.0 | 57.8 | 57.7 | 57.6 | 57.5 |
| Angle of elevation (°) | 12.2 | 12.2 | 11.9 | 12.1 | 12.3 | 12.4 | 12.3 | 11.8 |
| Carry (m) | 185.7 | 184.6 | 183.5 | 185.3 | 187.1 | 186.2 | 185.4 | 184.1 |
| Total distance (m) | 198.2 | 199.1 | 198.2 | 200.5 | 197.5 | 194.3 | 195.7 | 194.8 |
| HS = 45 m/s | | | | | | | | |
| Spin (rpm) | 2910 | 2870 | 2760 | 2820 | 3170 | 3340 | 3250 | 2720 |
| Initial velocity (m/s) | 67.2 | 67.1 | 67.1 | 67.1 | 67.1 | 67.0 | 67.0 | 67.1 |
| Angle of elevation (°) | 11.9 | 11.8 | 11.8 | 11.8 | 12.0 | 12.1 | 11.9 | 11.7 |
| Carry (m) | 206.2 | 204.7 | 205.0 | 204.9 | 207.5 | 207.3 | 206.8 | 204.5 |
| Total distance (m) | 216.3 | 215.1 | 215.9 | 214.6 | 213.5 | 212.3 | 215.8 | 215.4 |

*7Value for inner layer and outer layer combined.

Rubber strength (Shore D hardness) measurements were all carried out on the surface portion of the layer or cover.

The hardness of the finished golf ball is given as the deformation (mm) of the ball under a load of 100 kg.

Club used at a head speed of 35 m/s: Paradiso Titanium Mid; loft angle, 14°.

Club used at head speeds of 40 and 45 m/s: PRO 230 TITAN;
loft angle, 11°.

The results in Table 4 demonstrate that the thread-wound golf balls of the invention have excellent spin, initial velocity, and distance at all head speeds, and that a large gain in distance can be achieved even at a relatively low head speed of 35 m/s. By contrast, the thread-wound golf balls of Comparative Examples 1 and 2 wherein the outer layer of the center ball was too hard show either in excessive spin, a low launch angle, and insufficient distance at low head speeds (Comparative Example 1) or, in spite of an improvement in spin, poor rebound characteristics that were unable to provide an adequate distance (Comparative Example 2). The thread-wound golf ball of Comparative Example 3 sometimes failed to achieve a satisfactory initial velocity and hence, a gain in distance at a low club head speed.

The thread-wound golf ball of this invention has excellent spin, control and distance at all head speeds, in addition to which it is able to achieve a substantial gain in distance when hit by low club head-speed golfers.

Although some preferred embodiments have been described, many modifications and variations may be made thereto in light of the above teachings. It is therefore to be understood that the invention may be practiced otherwise than as specifically described without departing from the scope of the appended claims.

What is claimed is:

1. A thread-wound golf ball comprising; a center ball, a layer of rubber thread wound about the center ball, and a cover enclosing the rubber thread layer, said center ball having a two-layer construction comprising an inner layer and an outer layer, the center ball has a diameter of 30 to 36 mm and a weight of 19.5 to 31.5 g, the outer layer of the center ball has a specific gravity of 1.0 to 1.2, a Shore D hardness at least 5 units lower than the inner layer, and a thickness of 1 to 6 mm and a Shore D hardness of 20 to 45, the inner layer of the center ball has a Shore D hardness of 35 to 60, and the cover has a thickness of 1 to 3 mm.

2. A thread-wound golf ball according to claim 1, wherein the outer layer of the center ball is composed primarily of 1,4-polybutadiene and includes a filler in a ratio of up to 20 parts by volume per 100 parts by volume of rubber components.

3. A thread-wound golf ball according to claim 1, wherein the layer of rubber thread has a density of 0.65 to 0.85 g/cm$^3$.

4. A thread-wound golf ball according to claim 1, wherein the inner layer of the center ball is composed primarily of 1,4-polybutadiene and includes a specific gravity-adjusting amount of a filler having a specific gravity of at least 6.0.

5. A thread-wound golf ball according to claim 1, wherein the inner layer of the center ball is composed primarily of a resin material and includes a specific gravity-adjusting amount of a filler having a specific gravity of at least 6.0.

6. A thread-wound golf ball according to claim 1, wherein the specific gravity of said inner layer is 1.2 to 2.0.

7. A thread-wound golf ball according to claim 1, wherein the hardness of said inner layer is Shore D 40 to 55.

8. A thread-wound golf ball according to claim 1, wherein the diameter of said center ball is in the range of 23 to 33 mm.

9. A thread-wound golf ball according to claim 1, wherein said outer layer has a specific gravity in the range of 1.05 to 1.15.

10. A thread-wound golf ball according to claim 1, wherein said outer layer has a Shore D hardness in the range of 25 to 40.

11. A thread-wound golf ball according to claim 1, wherein said outer layer has a thickness in the range of 2 to 5 mm.

12. A thread-wound golf ball according to claim 1, wherein said center ball has a diameter in the range of 30 to 33 mm and a weight in the range of 19.5 to 26.0 g.

13. A thread-wound golf ball according to claim 1, wherein said cover has a thickness in the range of 1.5 to 2.5 mm and a Shore D hardness in the range of 35 to 65.

* * * * *